United States Patent [19]

Taragna et al.

[11] Patent Number: 4,664,276

[45] Date of Patent: May 12, 1987

[54] WARRANTY SEAL CAP

[75] Inventors: Luigi Taragna, Roma; Antonio Giovannelli, Anzio, both of Italy

[73] Assignee: Italcaps S.p.A., Aprilia, Italy

[21] Appl. No.: 719,563

[22] Filed: Apr. 3, 1985

[30] Foreign Application Priority Data

May 3, 1984 [IT] Italy ..... 48124A/84

[51] Int. Cl.[4] ..... B65D 41/42

[52] U.S. Cl. ..... 215/249

[58] Field of Search ..... 215/249, 253, 247; 220/266, 268, 281

[56] References Cited

U.S. PATENT DOCUMENTS

| | | | |
|---|---|---|---|
| 2,254,453 | 9/1941 | Scharmett | 220/281 |
| 3,379,326 | 4/1968 | Andersen | 215/249 |
| 3,410,436 | 11/1968 | Foss et al. | 215/249 X |
| 3,880,316 | 4/1975 | Martella | 220/281 X |
| 4,105,133 | 8/1978 | LaBarge et al. | 220/226 |
| 4,265,364 | 5/1981 | Baba | 215/249 |

OTHER PUBLICATIONS

"Outlook" pp. 5, 6, Nov. 1975.

*Primary Examiner*—Donald F. Norton

*Attorney, Agent, or Firm*—Cushman, Darby & Cushman

[57] ABSTRACT

A warranty seal cap, particularly for bottles to be used for pharmaceuticals in which a rubber diaphragm located on the mouth of the neck of the bottle is intended to be pierced by the needle which serves for the extraction of the liquid from the bottle, is characterized in that a button, breakable by means of a pressure acting downwards on the cap and bounded by an area that helps the opening, is provided in the top wall.

The area that helps the opening may be comprised of one or more weakening or score lines or one or more cuts.

In the case in which one or more cuts are provided for, if it is desired to assure the keeping of a sterile environment between the top wall and the rubber diaphragm, hermetic sealing means are provided between the button and the top wall, preferably an annular sealing gasket located at the cut area.

13 Claims, 5 Drawing Figures

WARRANTY SEAL CAP

The present invention refers to a warranty seal cap, i.e. to a cap, the opening of which cannot be closed again after use, particularly designed for employment on bottles to be used for pharmaceuticals, in which a needle must be inserted through a rubber diaphragm located on the mouth of the neck of the bottle in order to use the product contained in the bottle.

The bottles of the subject type comprise bottles containing blood, plasma and, generally, liquids for phleboclysises, as well as bottles containing powdered products, as, for instance, antibiotic, or even lyophilizated products, to which distillated water or any other useful liquid is to be added for use, for instance by means of a hypodermic syringe.

Bottles of such a type are usually closed by means of caps comprising a rubber diaphragm inside them, which is apt to be pierced by a syringe needle, whereas the rubber is covered outside by the top wall of the cap, which has a circular cut area, so as to form a disc held in its place by some tabs, generally three, to the cap itself.

However, this embodiment has some drawbacks, the main one of which is the complete lack of warranty provided for by the caps of this type. In fact there is the possibility of lifting one of the segments of the already cited disc, like an ear, between two contiguous holding tabs, and, after having violated the contents of the bottle, lowering the ear of the disc again, and making the cap look intact.

A further drawback happens in that the cuts carried out along the opening disc do not allow the outer surface of the rubber diaphragm, which even comes into contact with the needle when it is inserted into the bottle, to be kept aseptic.

Therefore, a number of seal caps for pharmaceutical bottles have been already studied, but they have not been favourably accepted, due to their high cost and to the difficulties of opening.

In fact, seal caps are known, carried out in a number of separate pieces; generally a first ring serves to hold the rubber diaphragm, whereas a disc, located on the diaphragm, serves as a seal and can be removed only by tearing another ring located outside and containing all the elements of the cap itself.

Therefore, such a cap appears to be disproportionately expensive both due to the quantity of the metal employed, and due to the difficulty in the assembling and closing of the various pieces, which does not allow high production speeds to be reached.

Therefore, the main object of the present invention is to provide a warranty seal cap simple in the execution and therefore cheap and suitable for mass production.

A further object of the present invention is to provide a warranty seal cap which allows a sterile environment to be maintained at the rubber diaphragm.

Still another object of the present invention is to provide a warranty seal cap which appears to be of simple use, both by the final user and by the product maker, allowing the automatic application by means of high speed machines.

The warranty seal cap according to the present invention is characterized in that a button, breakable by means of a pressure acting downwards on the cap and bounded by an area that helps the opening, is provided in the top wall.

The area that helps the opening can be comprised of one or more weakening or score lines or one or more cuts.

In the case in which one or more cuts are provided for, if it is desired to assure the keeping of a sterile environment between the top wall and the rubber diaphragm, hermetic sealing means are provided between the button and the top wall, preferably an annular sealing gasket located at the cut area.

Furthermore, the button can be provided with a knob for taking it away after having separated it from the top wall.

In the following, the present invention will be further clarified from the description of some forms of practical embodiment of the warranty seal cap, particularly for bottles to be used for pharmaceuticals, the, description made in a purely illustrative and not limitative way, with reference to the accompanying drawing, in which.

Figure 2:
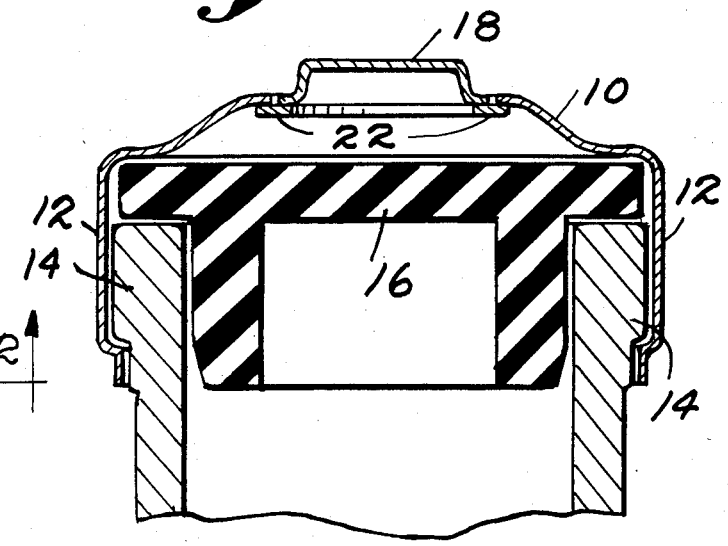
FIG. 2 is a cross-section view, in an enlarged scale with respect to the FIG. 1, of the cap, made according to the line II—II of FIG. 1.
Figure 1:
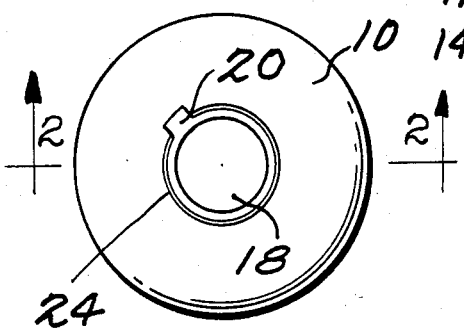
FIG. 1 is a top plan view of a warranty seal cap according to the present invention.

With reference to the accompanying drawing, and particularly to the plan view of FIG. 1 and to the corresponding cross-section of FIG. 2, it is seen that a first embodiment of the present cap comprises a top wall 10, which extends downwards in a peripheral band 12 designed to surround the outermost part of the mouth 14 of a bottle to be used for pharmaceuticals.

Between the mouth 14 and the top panel 10, there is placed a rubber diaphragm 16, designed to be pierced by a needle in the use of the bottle.

At the centre of the top wall 10 a precut button 18 is provided, which remains connected by means of a thin appendix 20 to the wall 10. An annular gasket or seal 22 is made to adhere on the lower surface of the top wall 10 at the cut area 24 in order to provide an hermetical sealing and therefore the possibility of sterilization and maintaining a sterile environment between the lower surface of the cap and the upper surface of the rubber diaphragm.

Obviously, the seal could be placed on the upper surface of the top wall, or other hermetic sealing means could be used in order to assure maintaining a sterile environment between the top wall 10 and the rubber diaphragm 16.

For use, the cap is broken by pressing, by means of a finger or any other suitable item, on the button 18, so as to cause the break of the seal 22 and the appendix 20.

Figure 3:
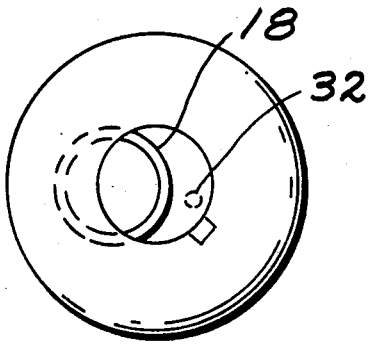
FIG. 3 is a plan view similar to FIG. 1 and shows the present cap with the seal broken.

Since the top wall 10 has a convex shape, between it and the rubber diaphragm 16, a chamber is provided, in which the button 18, thus separated, falls off. By means of a little inclination of the bottle, or in another way, the button 18 is made to slide laterally, as better shown in FIG. 3, so as to leave thus a free entrance for a needle 32 which has to pierce the rubber diaphragm 16.

It is evident that the button 18, once removed from its original position, can no longer be inserted again into the top wall 10. In such a manner it acts as a warranty seal assuring with its presence the integrity of the bottle and the sterility of the environment enclosed between the cap and the rubber diaphragm.

Figure 4:
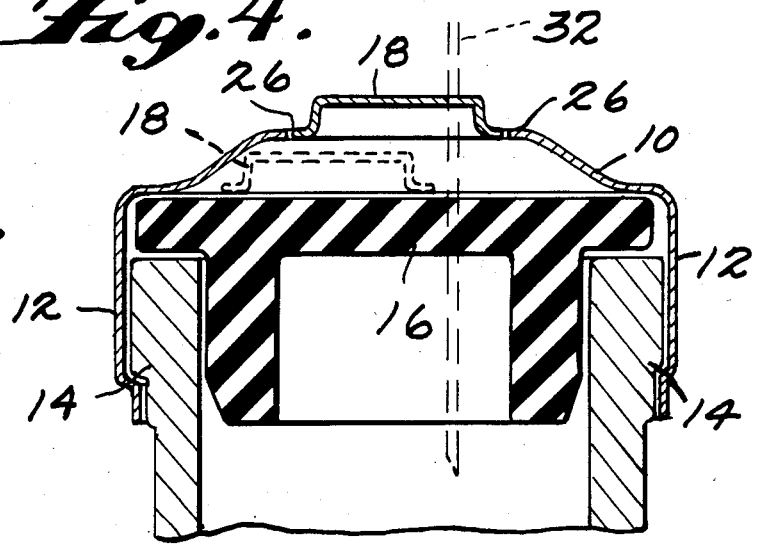
FIG. 4 is a cross-section view similar to FIG. 2 and shows another embodiment of the present seal cap.

In the modification shown in the cross-section of FIG. 4, the button 18 is not precut, but only marked by means of a score line 26, carried out by thrusting, but not cutting, the bounding area between the button 18 and the top wall 10. In this case the seal 22 can be omitted, since there is not a possibility of contamination, a cut not being there.

In FIG. 4 there is also shown, by broken lines, the button 18 removed and shifted laterally to leave room for the passage of the needle 32.

Figure 5:
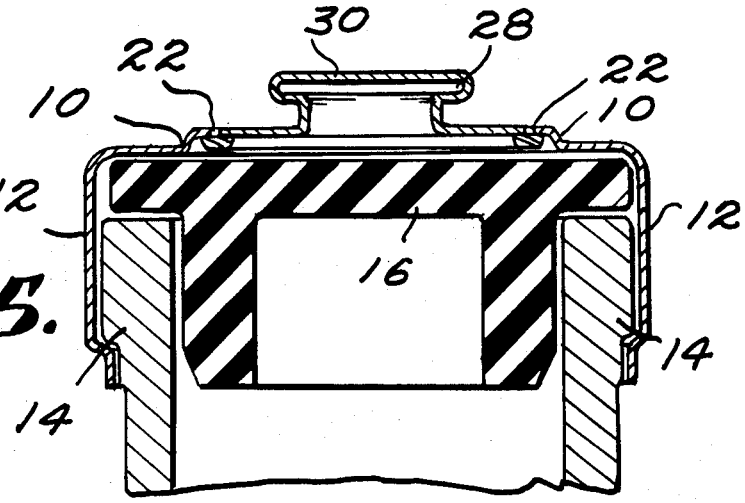
FIG. 5 is a cross-section view similar to FIG. 2 and shows still another embodiment of the present seal cap.

In the further embodiment form of a cap according to the present invention, shown in cross-section in FIG. 5, there is seen that a button 28 is used, having sizes substantially greater than that of the button 18. Furthermore, the button 28 is provided with a knob 30, by means of which it can be taken away after having been separated from the top panel 10, always by means of the application of a force going downwards as seen in FIG. 5, i.e. by pressing on the bottle.

Beyond the embodiment shown in FIG. 5, i.e. by carrying it out by cutting and application of the seal 22, the cap with button 28 provided with a knob 30 can obviously be carried out by using the technique of the score lines, described with reference to the FIG. 4.

It is obvious that other numerous and different changes and modifications can be performed by the skilled in the art on the embodiment forms of the present invention hereinbefore described, without departing from its scope. It is intended therefore that all these changes and modifications are encompassed in the field of this invention.

We claim:

1. A warranty seal cap, particularly for bottles to be used for pharmaceuticals, in which a rubber diaphragm located on the mouth of the neck of the bottle is intended to be pierced by a needle which serves for the extraction of the liquid from the bottle, said cap being characterized in that a button, breakable by means of pressure acting downwards on the cap and bounded by a weakened portion of said cap, is provided in the top wall of the cap, wherein said top wall is convex in shape so as to provide a chamber between itself and said rubber diaphragm, where said button is received after the opening operation.

2. A cap as in claim 1, characterized in that said weakened portion of said cap is comprised of a score line.

3. A cap as in claim 1, characterized in that said weakened portion of said cap is comprised of a cut area.

4. A cap as in claim 3, characterized in that said top wall and said button are connected by an appendix that interrupt said cut area.

5. A cap as in claim 3, characterized in that hermetic sealing means are provided between the button and the top wall in order to assure the keeping of a sterile environment between said top wall and the rubber diaphragm.

6. A cap as in claim 5, characterized in that said hermetic sealing means comprises an annular seal located at said cut area.

7. A cap as in claim 1, characterized in that said button is provided with a knob, by means of which it can be taken away after having been separated from the top wall of the cap by pressing on it.

8. A warranty seal cap for a pharmaceutical bottle in which bottle a rubber diaphragm is disposed on and completely covers the mouth of the neck of the bottle, said cap comprising, (a) a top wall arranged to be positioned above the diaphragm and spaced therefrom when said cap is fitted to the bottle neck, (b) a button disposed as part of said top wall, said button surrounded by a weakened portion and shaped so as to fit within the space between said top wall and the diaphragm when said cap is fitted to the bottle neck and when said button is pressed and broken away from said top wall, and (c) a peripheral band attached to said top wall and arranged to surround the outside of the mouth of the bottle.

9. A warranty seal cap is claimed in claim 8 wherein said weakened portion is a score line.

10. A warranty seal cap as claimed in claim 8 wherein said weakened portion is cut through, said button being connected to said top wall by means of an appendix protruding from said button.

11. A warranty seal cap as claimed in claim 10 wherein a hermetic seal is applied to said cut area, on the bottom side of said top wall and said button.

12. A warranty seal cap as in claim 11, wherein said hermetic seal applied to said cut area is annular.

13. A warranty seal cap as in claim 8, wherein said button is further comprised of a knob, such that said button may be removed from the space between said diaphragm and said top wall after said button is separated from said top wall.

* * * * *